US005427311A

United States Patent [19]

Kachmar

[11] Patent Number: 5,427,311

[45] Date of Patent: Jun. 27, 1995

[54] SIGNALING DEVICE

[76] Inventor: Paul E. Kachmar, 5830 Adelyn Rd., Pensacola, Fla. 32504

[21] Appl. No.: 228,711

[22] Filed: Apr. 18, 1994

[51] Int. Cl.[6] ..... B65D 91/00

[52] U.S. Cl. ..... 232/35

[58] Field of Search ..... 232/17, 34, 35, 37

[56] References Cited

U.S. PATENT DOCUMENTS

| | | | |
|---|---|---|---|
| 3,191,855 | 6/1965 | Margoni | 232/35 |
| 3,275,227 | 9/1966 | Bogue | 232/34 |
| 3,623,655 | 11/1971 | Tieszen | 232/35 |
| 4,018,379 | 4/1977 | Carter | 232/35 |
| 4,171,086 | 10/1979 | Hudson | 232/35 |
| 4,473,182 | 9/1984 | Dion | 232/35 |

*Primary Examiner*—Flemming Saether

*Attorney, Agent, or Firm*—George A. Bode; Michael L. Hoelter

[57] ABSTRACT

A signaling device that visibly indicates that the door of a mailbox has been opened. During operation, a signal flag is held in a generally vertical or elevated position by the door of the mailbox which remains closed. However, upon opening the door, restraint on the signal flag is released, thereby causing it to pivot downwardly and come to rest adjacent and atop the mailbox.

7 Claims, 3 Drawing Sheets

SIGNALING DEVICE

BACKGROUND OF THE INVENTION

1. Field of the Invention

This invention pertains to mechanical signaling devices in general and, more particularly, to a device that visibly indicates when the door of a mailbox has been opened.

2. General Background

Many devices exist which signal when the door of a rural-type mailbox has been opened. They each function differently, but all of them attempt to inform or signal the owner when mail has been delivered. Some of these devices can be secured to the mailbox without the need to modify, drill, puncture or otherwise alter the mailbox itself. One example of such a signaling device is disclosed in U.S. Pat. No. 4,793,552 issued to J. W. Revels. In accordance with this device, a signal flag is supported by friction in an upright position with depending legs connected thereto. These legs both engage and are moved by the door such that whenever the door is opened, the friction holding he signal flag upright is overcome, thereby causing this signal flag to pivot. This device is mounted to the original friction latch of the mailbox such as through a pair of encircling straps.

Another example of such a non-penetrating or non-modifying signaling device is shown in U.S. Pat. No. 4,840,307 issued to J. A. Hartman. In accordance with Hartman '307, a first plate is wedged underneath the upper latch member of the mailbox with a second plate being pivotally secured to this first plate. A spring is compressed so as to permit a tab secured to this second plate to be inserted in the gap between the mailbox housing and its door. Once the door is opened, however, the tab is no longer restrained and thus the biased spring pivots this second plate to an upright position.

A third example of such a non-invasive signaling device is shown in U.S. Pat. No. 4,711,391 issued to P. Roge, et al. In accordance with this device, a base plate is mounted to the top of the mailbox such as through the use of an adhesive or tape. Secured to this base plate is an elongated spring with a signal flag at its distal end. Basically, the tip of this signal flag is bent or configured so as to be restrained by a closed door. In this fashion, the spring is bent and held in a compressed position by the closed door/signal flag combination. Whenever the door is opened, the signal flag is released which allows the spring to return to its original shape with the signal flag coming to rest some distance from the mailbox atop the now unbiased upright spring.

A second group or type of signaling device generally requires some modification to the original mailbox. Such a modification may encompass the simple step of drilling or puncturing the outer surface of the box so as to bolt the device thereto, or the modification can require the replacement of the latch mechanism, or the modification can necessitate a supplement to the original latch mechanism.

One typical example of this type of signaling device is shown in U.S. Pat. No. 4,171,086 issued to Vencraft Corporation on the application of F. W. Hudson. This device incorporates a stand bolted to the top of the mailbox that pivotally supports a counterweighted signal flag. One end of this signal flag, the end opposite the counterweight, is restrained between the mailbox and its door such that the counterweight is now elevated. Upon opening the door, the restraint on this end of the signal flag is released, thereby enabling the counterweight to fall which consequently pivots the signal flag to an upright position.

Another example of this type of signaling device is illustrated in U.S. Pat. No. 4,473,182 issued to E. Dion. In accordance with Dion '182, the original friction latch supplied with the mailbox is replaced with one configured as shown. This replacement latch, when in the closed position, restrains an arm extending from a counterweighted signal flag in the down position. Upon opening the door, this arm is released and the counterweight pivots the signal flag to an upright position. Both the arm and the signal flag are supported upon a stand bolted to the top of the mailbox.

Still another example of this second type of signaling device is shown in U.S. Pat. No. 4,896,624 issued to J. R. Carnwath. This device illustrates a slender rod that is biased and held in a down position by a hook secured to the mailbox door. Upon opening the door, the rod is released and allowed to stand upright. Generally, a signal flag is secured to one end region of this rod for greater visibility. Additionally, this rod is typically secured to the top of the mailbox via a bracket threaded or bolted to the mailbox.

Yet another example of this second type of signaling device is shown in U.S. Pat. No. 4,491,268 issued to C. H. Faulkingham. This device operates similar to that described above with respect to Carnwath '624 in that a slender rod is restrained in a generally horizontal position via a special latch atop the mailbox. Whenever the door is opened, restraint on the rod is released, thereby permitting it to pivot to an upright position.

A third type of signaling device is one that is mounted elsewhere than on top of the mailbox. U.S. Pat. No. 4,756,472 issued to G. M. Hammons is illustrative of such a type of signaling device. In accordance with Hammons '472, a counterweighted lever is mounted, such as via a bolt, to the side of the mailbox. A stopping mechanism is likewise secured to the side of the door in order to support this lever in a generally horizontal position. Consequently, whenever the door is opened, the stopping mechanism is removed from further contact with the counterweighted lever which is now free to pivot to an upright position, thereby signaling that the door had been opened.

While each of these devices may operate as indicated, they all generally are initially held or biased in a horizontal position such that, upon opening the door, pivot to a generally vertical position. The exception to this is Revels '552 which relies upon friction to restrain the signal flag in place and direct contact between a pair or extensions and the mailbox door in order to pivot the signal flag to a generally horizontal position.

It is thus an object of this invention to provide a signaling device that operates in a manner directly opposite known signaling devices.

Still another object of this invention is to provide a signaling device that normally is restrained in an upright or vertical position and, when tripped, pivots downwardly so as to come to rest at a generally horizontal position.

Yet another object of this invention is to provide a signaling device whose signal flag can be easily removed and/or replaced with a device more to the liking of the user.

Still another object of this invention is to utilize the signal flag itself as a counterweight rather than require the attachment of a separate counterweight.

A further object of this invention is to secure the signaling device to the top of this mailbox such as through screws or bolts or the like. These and other objects and advantages will become obvious upon further investigation.

SUMMARY OF THE PRESENT INVENTION

The preferred embodiment of the apparatus of the present invention solves the aforementioned problems in a straightforward and simple manner. What is provided is a signaling device that is secured to a mailbox having an openable door. A mounting assembly secures an elongated member to the mailbox while a pivot assembly pivotally secures this elongated member to the mounting assembly via a pivot point. This pivot point is located in an offset position along the length of the elongated member and thus divides this elongated member into a first long portion and a second short portion. A signal flag is secured to the distal end of the first long portion with this signal flag and first long portion being the counterweight required to pivot the elongated member about the pivot point. A restraining assembly forms a part of the distal end of the second short portion and this assembly restrains both the first long portion and the signal flag in an elevated position above the mailbox whenever the door is closed. However, whenever the door of the mailbox is opened, restraint on the second short portion is released, thereby permitting both the signal flag and the first long portion to pivot the elongated member about the pivot point resulting in the signal flag and the first long portion coming to rest adjacent and atop the mailbox.

BRIEF DESCRIPTION OF THE DRAWING

For a further understanding of the nature and objects of the present invention, reference should be had to the following description taken in conjunction with the accompanying drawing in which like parts are given like reference numerals and, wherein.

DETAILED DESCRIPTION OF THE PREFERRED EMBODIMENT

Figure 5:
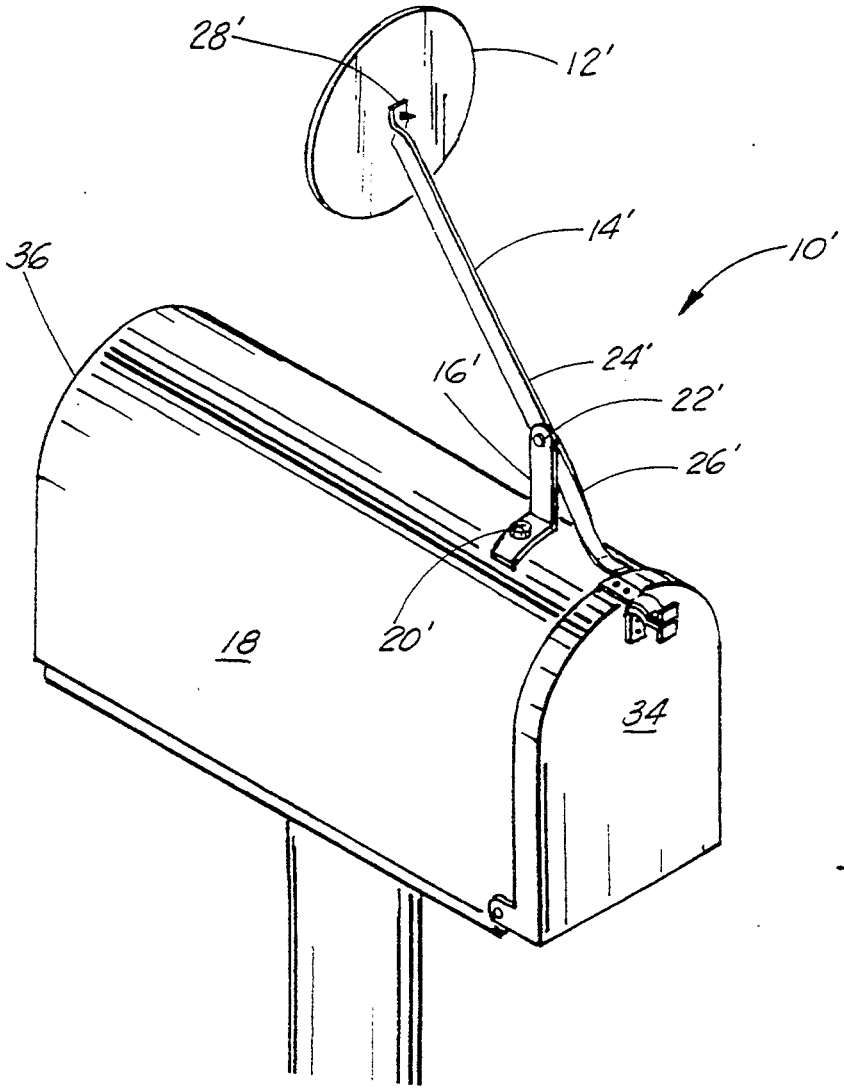
FIG. 5 is a perspective view of the preferred embodiment of the apparatus of the present invention illustrating the elongated arm as a bent plate member; and, FIG. 6 is a side view of the embodiment of FIG. 5 illustrating its operation and with the mailbox in PHANTOM.
Figure 6:
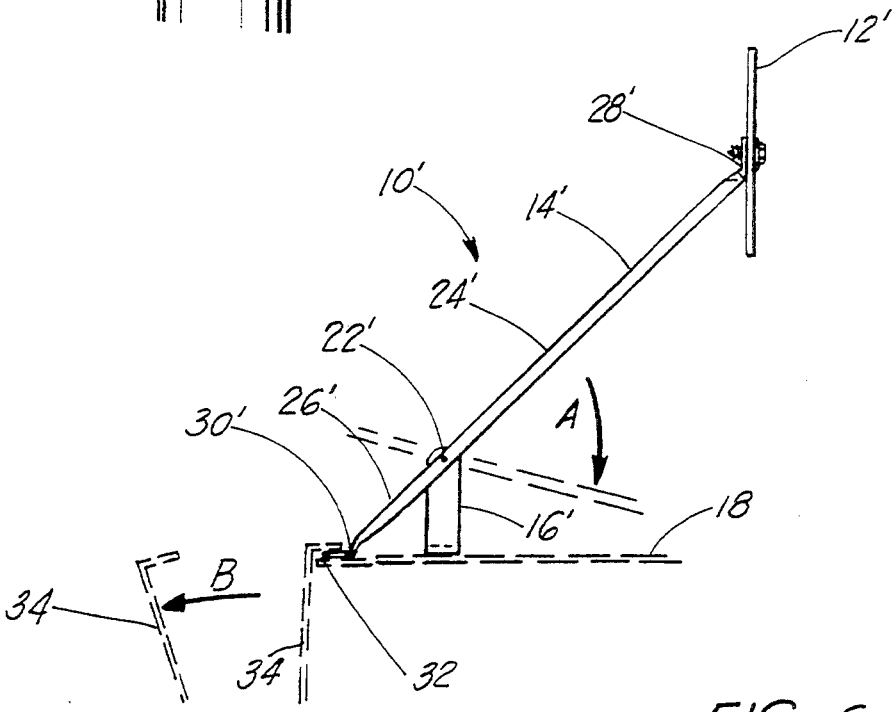

In referring to the drawings, primed numbers shall refer to the preferred embodiment (10') of the present invention illustrated in FIGS. 5 and 6. There is shown signaling device 10, 10' which includes a signal flag 12, 12', a pivotable elongated arm 14, 14' extending from signal flag 12, 12' and a stand or base 16, 16' securing signaling device 10, 10' to mailbox 18.

Stand or base 16, 16' is typically bolted, welded, glued, or otherwise affixed to the top of mailbox 18, such as through conventional nut (not shown) and bolt 20. While in the alternate embodiment of FIGS. 1–4, stand 16 is illustrated as being configured of a bent metal plate, stand 16 may also be otherwise configured and it may also be constructed of plastic, fiberglass, hard rubber, or some other rigid or semi-rigid material. Stand 16, 16' can also be permanently affixed to the top of mailbox 18 or it can be affixed so that it can be removed at a later date if so desired.

Elongated arm 14, 14', which may be curved or which may be straight, is pivotally mounted to stand 16, 16' via pivot point 22, 22', thereby permitting arm 14, 14' to pivot (ARROW A, for example) with respect to stand 16, 16' and hence mailbox 18. Preferably, arm 14, 14' is mounted to stand 16, 16' in an offset position thereof with pivot point 22, 22' dividing arm 14, 14' into a first long portion 24, 24' and a second short portion 26, 26'. The length of long and short portions 24, 26 and 24', 26' are, of course, not equal to each other with first portion 24, 24' being longer than second portion 26, 26'.

Signal flag 12, 12' is preferably removably secured to distal end 28, 28' of long portion 24, 24' such as by a nut and bolt, a clip, a threaded screw or the like. In this fashion, different signal flags 12, 12' can be secured to distal end 28, 28' such as one or more reflectors, flags, painted objects, or other high visibility devices. However, it may be desirable to more permanently secure signal flag 12, 12' to arm 14, 14', such as by welding. In any event, the weight of signal flag 12, 12' in conjunction with its placement at distal end 28, 28' of long portion 24, 24' of arm 14, 14' will cause this portion of arm 14, 14' to rotate by gravity (in the direction of ARROW A in FIGS. 2 and 6) about pivot point 22, 22' unless otherwise restrained. Such rotation will, of course, cause second or short portion 26, 26' of arm 14, 14' to be pivoted upwardly.

Figure 3:
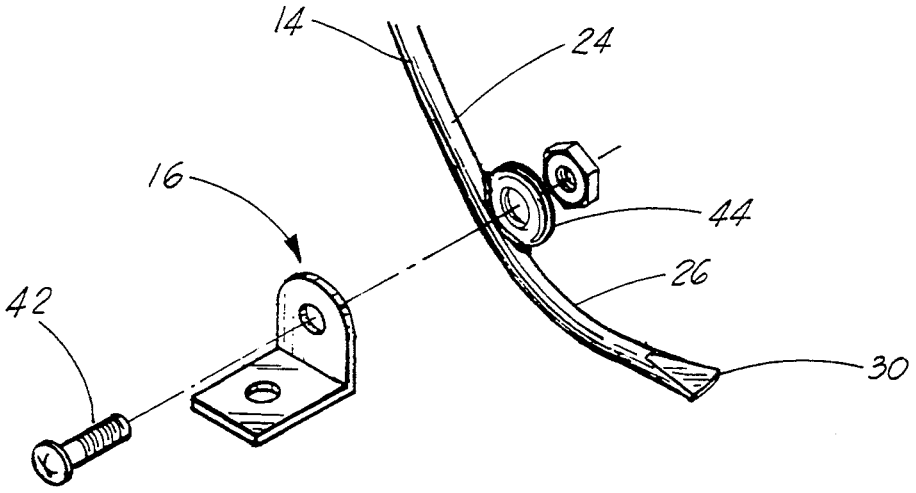
FIG. 3 is an exploded perspective view illustrating one manner of securing the signaling device of FIG. 1 to a mailbox (not shown)

Referring now to FIGS. 3 and 6, end 30, 30' of short portion 26, 26' is configured to be inserted within the gap 32 existing between mailbox 18 and its door 34. Such a configuration of end 30, 30' may be flattened as shown or it can be wedge-shaped or some other shape if so desired. The important point being to restrain this end 30, 30' within gap 32 until door 34 is opened, at which time opposite or distal end 28, 28' of arm 14, 14' and signal flag 12, 12' are pivoted downwardly (ARROW A) toward mailbox 18 via gravity.

By such construction, stand 16, 16' will be secured to mailbox 18 at a position closer to or adjacent door 34 rather than closer to or adjacent the back or other end 36 of mailbox 18. The exact position of stand 16, 16' with respect to mailbox 18 will need to be located and/or adjusted in order to permit end 30, 30' of short portion 26, 26' to fit within gap 32 between mailbox 18 and door 34.

Figure 1:
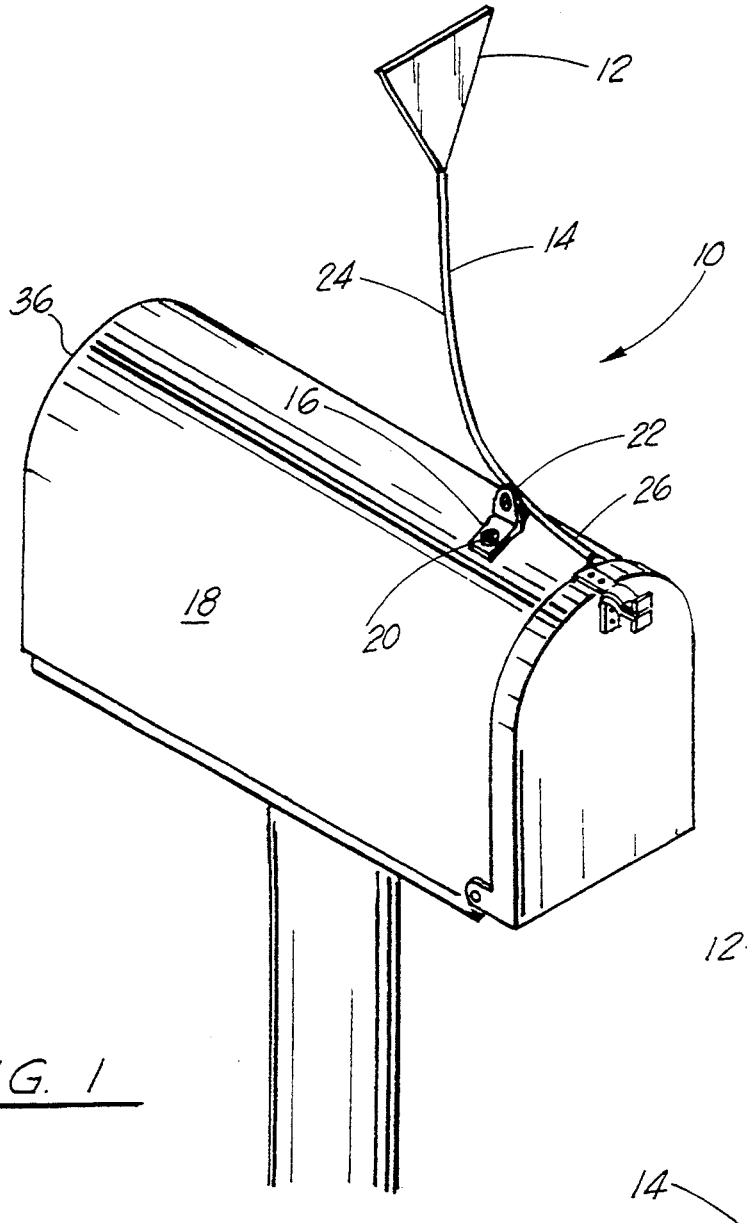
FIG. 1 is a perspective view of an alternate embodiment of the apparatus of the present invention with the signal flag in the "up" or vertical position and with the door to the mailbox in the closed position.
Figure 4:
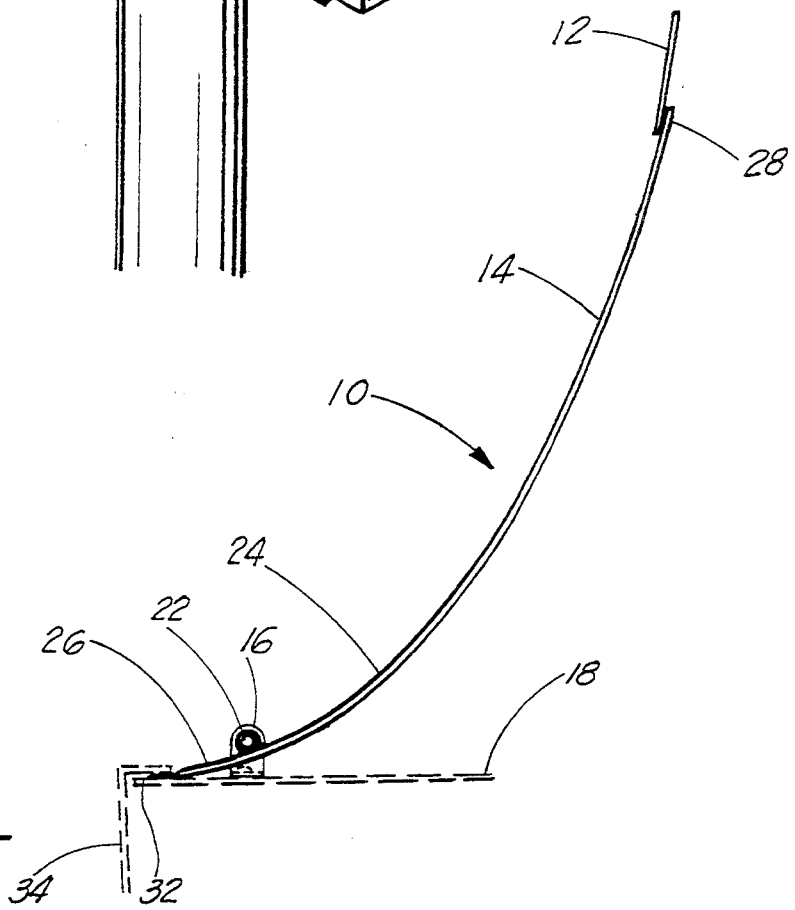
FIG. 4 is a side perspective view illustrating the restraint on the signaling device of FIG. 1 by the closed door of the mailbox (in PHANTOM)

During operation, end 30, 30' of second or short portion 26, 26' of arm 14, 14' will be inserted in gap 32 as shown in FIGS. 4 and 6. This may be accomplished by simply butting or pivoting end 30, 30' against mailbox 18 and then closing door 34 so as to restrain end 30, 30' in place in gap 32. Should arm 14, 14' be made of material more flexible than metal, (i.e. plastic, rubber, fiberglass,, etc.) it may be possible to first close door 34 and then bend or flex short portion 26, 26' until it slides within gap 32. Other means of restraining arm 14, 14' in place are also possible. It should also be indicated that no special handle or finger latch is required for the operation of signaling device 10 nor is there a need to secure a special catch or restraining clip to door 34 so as to hold arm 14, 14' in place.

Figure 2:
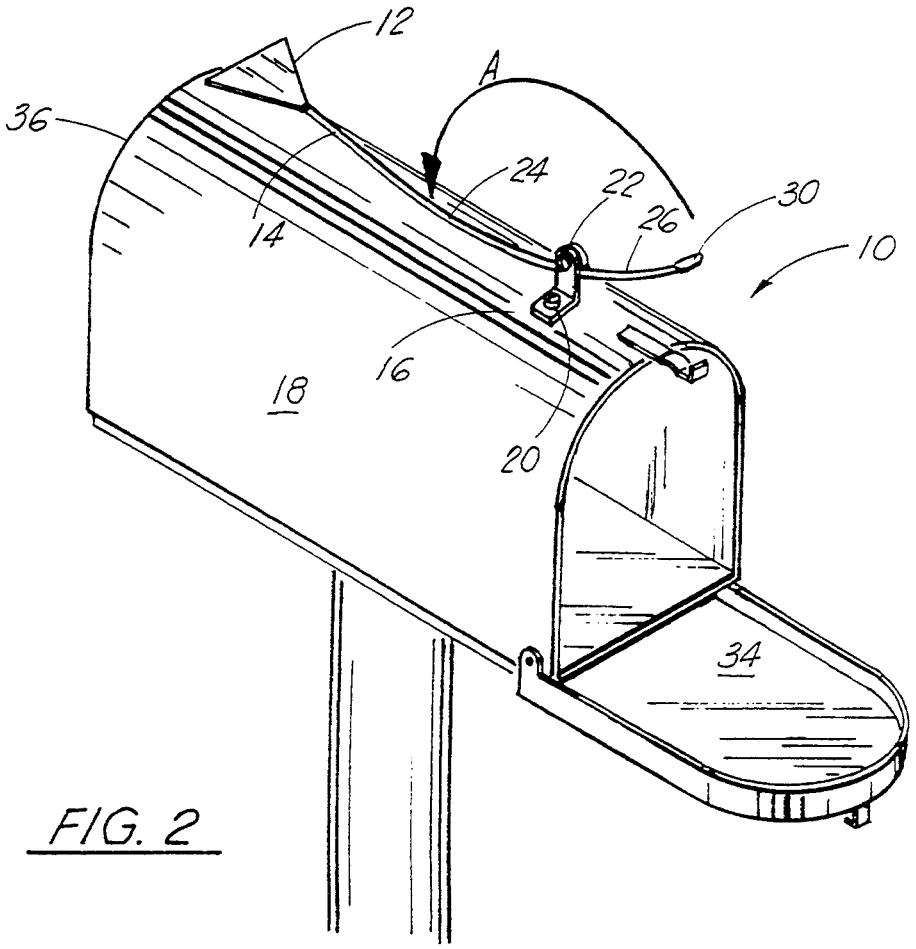
FIG. 2 is a similar perspective view of the embodiment of FIG. 1 with the signal flag in the "down" or horizontal position and with the door to the mailbox in the opened position.

Once signaling device 10, 10' is set as indicated above, first or long portion 24, 24' of arm 14, 14', with signal flag 12, 12' secured thereto, will be restrained in an elevated or vertical position (of FIGS. 1, 4, 5 and 6) via pivot point 22, 22'. Consequently, signal flag 12, 12' will be readily visible from a distance. However, once door 34 is opened as indicated by ARROW B of FIG. 6, the restraint on end 30, 30' of short portion 26, 26' will be released. This will cause long portion 24, 24' of arm 14, 14' to pivot downwardly via gravity, as shown by ARROW A of FIGS. 2 and 6, about pivot point 22, 22' and come to rest in a generally horizontal position (FIG. 2 and in PHANTOM view in FIG. 6).

Such movement under gravity of long portion 24, 24' will be greatly assisted by the weight or mass of signal flag 12, 12' located at distal end 28, 28'. Essentially, signal flag 12, 12' and long portion 24, 24' act as a counterweight, thereby negating the need for signal device 10, 10' to incorporate a separately located counterweight. The weight or mass of signal flag 12, 12' and long portion 24, 24' forward of pivot point 22, 22' will easily overcome any resistance offered by short portion 26, 26', thereby causing short portion 26, 26' to pivot upwardly (FIGS. 2 and 6). This movement or rotation about pivot point 22, 22' is generally controlled by the moment force created about pivot point 22, 22'. In other words, the moment about pivot point 22, 22' causing signal flag 12, 12' to move downwardly (ARROW A) toward mailbox 18 is greater than the moment force resisting such moment and generated by short portion 26, 26'. This moment force is defined as force times moment arm with the values of force and moment arm or distance in this equation being greater for long portion 24, 24' than they are for short portion 26, 26'.

In some embodiments, arm 14' may be a strip of flat material that is bent as needed (see FIGS. 5 and 6), in other embodiments, arm 14 may consist of a slender rod or some other such elongated member (FIGS. 1–4). Additionally, pivot point 22 may consist of a connection so simple that it requires nothing more than a pin or bolt 42 (FIG. 3) loosely secured between stand 16 and arm 14. Other configurations of pivot point 22 may incorporate a washer 44 welded or otherwise secured to arm 14 with bolt 42 passing through washer 44 and secured to stand 16. Of course, a multitude of other means of pivotally mounting arm 14, 14' on stand 16, 16' are also likely, the important aspect being the ability of arm 14, 14' to pivot with respect to stand 16, 16'.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A signaling device secured to a mailbox having an openable door, comprising:

(a) mounting means for mounting a curved elongated rod-like member to said mailbox;

(b) pivot means comprising a pivot point for pivotally securing said rod-like member to said mounting means, said pivot point being located in an offset position along the length of said rod-like member, thereby dividing said rod-like member into a first long portion and a second short portion, said second short portion being configured at its distal end to snugly fit within a gap created between said mailbox and the door of said mailbox whenever said door is in the closed position;

(c) signal means removably secured to the distal end of said first long portion, said signal means and said first long portion being the counterweight for pivoting said elongated member about said pivot point; and, (d) restraining means forming a part of the distal end of said second short portion for restraining said first long portion and said signal flag in an elevated and generally vertical position above said mailbox when said door is closed, whereby when said door of said mailbox is opened restraint on said second short portion is released thereby permitting said signal and said first long portion to pivot said rod-like member about said pivot point causing said signal and said first long portion to come to rest adjacent and atop said mailbox in a generally horizontal position.

2. The apparatus as set forth in claim 1, wherein said pivot means comprise a bolt or pin passing loosely through said mounting means and said elongated member.

3. The apparatus as set forth in claim 2, wherein said signal comprises reflector means.

4. The apparatus as set forth in claim 2, wherein said signal comprises a painted surface.

5. The apparatus as set forth in claim 2, wherein said signal comprises a triangularly shaped flag.

6. A method of signaling when the door to a mailbox has been opened comprising the steps of:

(a) mounting a stand or base upon the mailbox;

(b) pivotally securing an elongated member to said stand or base via a pivot point, said pivot point being located in an offset position along the length of said elongated member, thereby dividing said elongated member into a first long portion and a second short portion;

(c) securing a signal means to the distal end of said first long portion, said signal means and said first long portion being the counterweight required to pivot said elongated member about said pivot point;

(d) restraining said first long portion and said signal means in an elevated position above said mailbox when said door is closed, whereby when said door of said mailbox is opened, restraint is released, thereby permitting said signal means and said first long portion to pivot said elongated member about said pivot point causing said signal means and said first long portion to come to rest adjacent and atop said mailbox;

(e) configuring the distal end of said second short portion to fit within a gap created between said mailbox and said door when said door is in the closed position;

(f) flattening said distal end of said second short portion so as to fit within said gap;

(g) configuring said signal flag to be removable and replaceable upon the said distal end of said first long portion;

(h) positioning said first long portion in a generally vertical position when in said elevated position above said mailbox and further positioning said first long portion in a generally horizontal position when it comes to rest adjacent and atop said mailbox;

(i) curving or bending said elongated member along its length; and, (j) constructing and arranging said elongated member as a rod-like member.

7. The method as set forth in claim 6 further comprising the step of constructing and arranging said pivot point as a bolt or pin which passes loosely through said stand or base and said elongated member.

* * * * *